US012163306B2

(12) United States Patent
Balas et al.

(10) Patent No.: US 12,163,306 B2
(45) Date of Patent: Dec. 10, 2024

(54) SHEATH FORMED BY AT LEAST ONE CIRCULAR KNIT FOR PRODUCING A REINFORCED CONCRETE PILE

(71) Applicant: C.H.A.B, Saint-Romain-de-Popey (FR)

(72) Inventors: Olivier Balas, Ecully (FR); Alexandre Saunier, Montrottier (FR); Loic Alirand, Ecully (FR)

(73) Assignee: C.H.A.B, Saint-Romain-de-Popey (FR)

( * ) Notice: Subject to any disclaimer, the term of this patent is extended or adjusted under 35 U.S.C. 154(b) by 543 days.

(21) Appl. No.: 17/430,598

(22) PCT Filed: Feb. 18, 2020

(86) PCT No.: PCT/FR2020/050293
§ 371 (c)(1),
(2) Date: Aug. 12, 2021

(87) PCT Pub. No.: WO2020/169916
PCT Pub. Date: Aug. 27, 2020

(65) Prior Publication Data
US 2022/0145564 A1 May 12, 2022

(30) Foreign Application Priority Data
Feb. 21, 2019 (FR) ..... 19/01768

(51) Int. Cl.
*E02D 5/66* (2006.01)
*B21F 27/02* (2006.01)
(Continued)

(52) U.S. Cl.
CPC ..... *E02D 5/665* (2013.01); *B21F 27/02* (2013.01); *B21F 27/121* (2013.01); *D04B 9/44* (2013.01);
(Continued)

(58) Field of Classification Search
CPC combination set(s) only.
See application file for complete search history.

(56) References Cited

U.S. PATENT DOCUMENTS 3,805,535 A * 4/1974 Van Weele ..... E02D 5/385 405/237
4,594,206 A * 6/1986 Grafton ..... E02B 3/06 264/257
(Continued)

FOREIGN PATENT DOCUMENTS

CN 1782156 A 6/2006
CN 206635746 U 11/2017
(Continued)

OTHER PUBLICATIONS

International Search Report issued Jun. 5, 2020 re: Application No. PCT/FR2020/050293, pp. 1-3, citing: DE 102012004980 A1, GB 935797 A, DE 20120859 U1, EP 0593326 A1, EP 0909847 A1, FR 2287561 A1 and GB 674559 A.

*Primary Examiner* — Kyle Armstrong
(74) *Attorney, Agent, or Firm* — CANTOR COLBURN LLP

(57) ABSTRACT

A sheath for constructing a reinforced concrete pile, characterized in that the sheath is formed by at least one circular knit having a series of meshes helically positioned so as to form a pipe. A method for constructing a reinforced concrete pile includes excavating to form a well, inserting one end of a reinforcing rod in a sheath, positioning the sheath on an area of the rod and introducing the rod into the well, installing a tremie pipe inside the rod, and filling the well with concrete using the tremie pipe.

10 Claims, 6 Drawing Sheets

(51) Int. Cl.

| | |
|---|---|
| ***B21F 27/12*** | (2006.01) |
| ***D04B 9/44*** | (2006.01) |
| ***E02D 5/38*** | (2006.01) |

(52) U.S. Cl.

CPC ..... *E02D 5/38* (2013.01); *E02D 2250/003* (2013.01); *E02D 2300/0006* (2013.01); *E02D 2300/002* (2013.01); *E02D 2300/0078* (2013.01); *E02D 2600/00* (2013.01)

(56) References Cited

U.S. PATENT DOCUMENTS

| | | | | | |
|---|---|---|---|---|---|
| 5,593,623 | A * | 1/1997 | Mohss | ..... | E04G 13/021 264/32 |
| 10,767,333 | B2 * | 9/2020 | Tokuno | ..... | E02D 7/00 |
| 2008/0066499 | A1 | 3/2008 | Andrieu et al. | | |
| 2012/0118881 | A1 | 5/2012 | Holland et al. | | |
| 2015/0275455 | A1 | 10/2015 | Tokuno | | |

FOREIGN PATENT DOCUMENTS

| | | | | | |
|---|---|---|---|---|---|
| DE | 20120859 | U1 | | 5/2003 | |
| DE | 102012004980 | A1 | | 8/2013 | |
| EP | 0593326 | A1 | | 4/1994 | |
| EP | 0909847 | A1 | | 4/1999 | |
| FR | 2287561 | A1 | | 5/1976 | |
| GB | 674559 | A | | 6/1952 | |
| GB | 935797 | A | | 9/1963 | |
| GB | 1315075 | A | * | 4/1973 | ..... E02D 5/00 |
| JP | H03260216 | A | | 11/1991 | |
| JP | 2008291574 | A | | 12/2008 | |
| JP | 20107203 | A | | 1/2010 | |
| JP | 2010516927 | A | | 5/2010 | |
| JP | 2014517164 | A | | 7/2014 | |
| JP | 201782513 | A | | 5/2017 | |

* cited by examiner

SHEATH FORMED BY AT LEAST ONE CIRCULAR KNIT FOR PRODUCING A REINFORCED CONCRETE PILE

TECHNICAL FIELD

The disclosure concerns the field of civil engineering and more particularly a sheath for constructing a reinforced concrete pile.

BACKGROUND

A construction of a structure, such as a building, a civil engineering structure, or a communication route for example, requires that the structure rests on a stable subsoil, in order to support the weight of said structure. However, as constructions keep increasing, it is more and more frequent to have to build on a poor-quality subsoil.

By poor-quality subsoil, it should be understood a subsoil that does not have the required stability qualities. A poor-quality subsoil may feature, for example:

- a layer containing a high proportion of compressible materials, such as peat, mud, a pocket of water or soft clay for example;
- a layer of altered limestone (karstic soil) and voids of dissolutions more or less filled with limestone scree, or alluvium for example;
- or a layer formed by a quarry void.

A poor-quality subsoil can be reinforced by a rigid inclusion, i.e. a concrete column also called a pile, which allows for the weight of the structure to be transferred to a deep layer having the required stability qualities.

There is a known a solution for constructing a concrete pile, called a "cased bored pile technique", in which a well is first made by drilling. Then, a rigid tube, usually made of steel, is inserted over at least the entire height of the poor-quality layer of the well. Then a reinforcing metallic rod is introduced into the pipe. The reinforcing rod allows reinforcement of the pile so as to obtain a reinforced concrete pile. Thus, the reinforcing rod improves mechanical properties of the pile. Finally, a tremie pipe is installed in the reinforcing rod in order to pour the concrete.

The tube is intended on the one hand to contain a hydrostatic pressure of the concrete during the pouring of the latter, that is to say the force exerted by the weight of the concrete in equilibrium, and on the other hand to serve as a concrete formwork so as to keep said concrete in place while it becomes self-supporting by setting.

This technique has the drawback of using a rigid pipe which is very expensive, difficult to transport because of its volume, requires considerable handling means for its implementation such as for example a crane, and may require performing a welding of several pipes according to the desired height. Furthermore, the implementation of the rigid pipe, depending on the weather conditions, may present a significant risk for the safety of personnel. Thus, it is known to replace the rigid pipe with a flexible geotextile sheath formed by a substantially rectangular part, two opposite edges of which are connected together by means of a seam. In this way, the transport and the implementation of the sheath are facilitated. However, said sheath has low strength such that it is unable to counter the hydrostatic pressure of concrete on a borehole with a height larger than 5 meters. Furthermore, the sheath lets concrete escape at the seam of geotextile, which leads to overconsumption of concrete.

Finally, the sheath does not allow sufficient evacuation of water from the concrete resulting in poor setting of the concrete.

SUMMARY

The disclosure aims at overcoming all or part of the aforementioned drawbacks by proposing a sheath for making a reinforced concrete pile, characterized in that the sheath is formed by at least one circular knit comprising a series of meshes helically positioned so as to form a pipe.

A knit is a fabric made up of loops of yarns called "meshes". Each mesh is made up of a head, two legs and two feet. In a horizontal direction, that is to say according to an axis transverse to an axis of elongation of the legs of the mesh, a series of meshes is called a row of meshes. In a vertical direction, that is to say according to the axis of elongation of the legs of the mesh, a series of meshes is called a column of meshes. In a knit, the meshes are interlaced according to a defined pattern, which is called weave or tying. A distinction is made between knits having a pattern called weft meshes, in which a yarn is associated with a row of meshes, and a pattern called warp meshes or «chain» knits known as run-proof, in which a yarn is associated with a needle, so there will be as many needles as there are yarns.

Unlike weaving, that is to say a fabric in which two sets of yarns are interlaced at right angles, the knit is a fabric which is extensible according to the horizontal direction and according to the vertical direction. The extensibility of the knit depends on the one hand on the interlacing pattern of the meshes and on the other hand on the nature of the yarns which compose it. In other words, a knit inherently has a higher extensibility than the extensibility of the yarns that compose it.

A circular knit comprises at least one row of meshes of a determined length. More specifically, the length of the row of meshes is determined by a ratio of a length of used yarns to a number of needles or to a number of turns. The meshes of the row of meshes are helically interlaced so as to form a tube. The circular knit has a homogeneous structure, that is to say that there is no seam.

Thus, the sheath formed by the circular knit has homogeneous elasticity characteristics according to an axis of elongation of the sheath, that is to say along the column of meshes, and according to an axis radial to the axis of elongation of the sheath, that is to say along the row of meshes. The elasticity along the axis of elongation of the sheath may be different from the elasticity of the sheath along the radial axis.

As a result, the sheath according to the disclosure is particularly adapted to extend according to the radial axis so as to handle an overpressure phenomenon which appears, when using the sheath, at the time of an injection of concrete in a borehole.

Furthermore, the sheath according to the disclosure may, when using the sheath, easily adapt to the shapes of the subsoil and withstand a hydrostatic pressure of the concrete.

Finally, the sheath according to the disclosure does not have a weakness area thus allowing retaining the concrete inside the sheath.

According to a feature of the disclosure, the sheath is formed by a plurality of tubular knits inserted into one another in a coaxial manner.

Thus, the strength of the sheath with respect to tears is increased.

According to a feature of the disclosure, the at least one circular knit has an elasticity allowing an elongation comprised between 10% and 400% of a flat diameter of said circular knit.

The flat diameter of the knit corresponds to a width of the sheath according to an axis transverse to the axis of elongation of the sheath, when the sheath is folded on itself so as to extend in a plane.

In this way, the sheath has sufficient elasticity to absorb overpressure phenomena while controlling the maximum amount of concrete that can be injected into it.

Preferably, the at least one circular knit has an elasticity allowing an elongation comprised between 25% and 75% of the flat diameter of said circular knit.

According to a feature of the disclosure, the circular knit has an elasticity along the axis of elongation of the circular knit allowing for an elongation comprised between 0% and 150%.

According to a feature of the disclosure, the at least one circular knit is permeable. Thus, when the sheath is filled with concrete, the circular knit allows water, another liquid or a binding agent present in the concrete to be evacuated. In this way, a setting, that is to say a crystallization or a hardening, of the concrete is carried out according to the rules of the art.

According to a feature of the disclosure, the meshes are interlaced according to a pattern selected from: a pattern called «Jersey», a pattern called «1/1 ribs», a pattern called «2/2 ribs», or a pattern called "Interlock".

The pattern called «Jersey» is a pattern in which all meshes are threaded in the same way in the mesh of the row below.

The pattern called "1/1 rib" is a pattern in which there is an alternation of a so-called "inside" mesh and a so-called "outside" mesh.

The so-called «interlock» pattern is a pattern in which two «1/1 rib» patterns are interlaced.

The pattern called «2/2 rib» is a pattern in which there is an alternation of two meshes called «inside» and two meshes called «outside».

According to a feature of the disclosure, the at least one circular knit comprises at least one tuck mesh.

A tuck mesh, also called a float mesh or double mesh, is a mesh on which a load loop is positioned.

Thus, the strength of the circular knit is improved. Furthermore, the tuck meshes make it possible to prevent unraveling of the knit in the event of a tear.

According to a feature of the disclosure, the at least one circular knit comprises a plurality of tuck meshes.

According to a feature of the disclosure, the tuck meshes are evenly distributed in the circular knit.

According to a feature of the disclosure, the at least one tubular knit is made with at least one yarn made of a material selected from: a synthetic material, a cellulosic material, a plant material, an animal material, a mineral material, a metallic material.

The yarns made of a synthetic material are fibers obtained from petroleum derivatives.

The yarns made of a cellulosic material comprise cellulose molecules.

The yarns made of a plant material are derived from the environment, that is to say from plants.

The yarns made of animal material are derived from animals.

The yarns made of a mineral material are made of minerals such as rock, sand, natural stone . . . .

The yarns made of a metallic material involve a metallic bond.

Thus, depending on the choice of the yarn(s) of the knit, the at least one knit has improved mechanical strength at a highly basic pH (the pH of the concrete is 13) and against corrosion and a UV resistance.

According to a feature of the disclosure, the synthetic yarn is made of a material selected from: polyester, high tenacity polyester, high modulus polyethylene, high modulus polyester, high modulus para-aramid.

Polyester results from the condensation of two components derived from petroleum: an acid (terephthalic acid) and an alcohol (ethylene glycol). Polyester has high elasticity.

High tenacity polyester has high resistance to breakage and abrasion. High tenacity polyester is also particularly UV stable.

High modulus polyethylene is a polyethylene fiber with a very high molecular weight (UHMPE) with excellent abrasion resistance.

High modulus polyester is a thermoplastic liquid crystal polymer (LCP) belonging to the family of aromatic polyesters.

High modulus para-aramid is an organic fiber belonging to the family of aramids or aromatic polyamides, the scientific name of which is poly-para-phenylene terephthalamide (PPDT).

According to a feature of the disclosure, the at least one tubular knit is made with at least one yarn having a tenacity comprised between 5 and 50 cN/dtex.

The tenacity is expressed as the load in decanewtons (daN) necessary to break a yarn with a section of 1 $mm^2$.

Thus the at least one knit has improved mechanical strength.

According to a feature of the disclosure, the at least one tubular knit is made with at least one yarn having a moisture uptake of less than 10%, preferably less than 5%.

According to a feature of the disclosure, the at least one tubular knit is made with at least one yarn with a density of less than 10, preferably less than 1.5.

Thus the sheath remains lightweight to handle.

According to a feature of the disclosure, the at least one tubular knit is made with at least one yarn which is inert with respect to the environment.

In this way, the sheath respects the environment in which it is placed.

According to a feature of the disclosure, the at least one tubular knit is made with at least one yarn having an elasticity of less than 50%.

The disclosure also relates to a method for making a reinforced concrete pile, said method comprising:

an step of excavation so as to form a well;

a step of inserting one end of a reinforcing rod in a sheath according to any one of the preceding claims;

a step of positioning the sheath on a determined area of the reinforcing rod;

a step of introducing the reinforcing rod into the well;

a step of installing a tremie pipe inside the reinforcing rod;

a step of filling the well with concrete using the tremie pipe.

Thus the method makes it possible to easily make a reinforced concrete pile.

Furthermore, the method makes it possible to position the sheath on a predetermined height of the well making it possible to cover or not the entire well.

According to a feature of the disclosure, the determined area of the reinforcing rod is smaller than an area corresponding to a total height of the reinforcing rod.

Thus, the determined area has a lower height than the total height of the reinforcing rod. In this way, the sheath does not cover the entire reinforced concrete pile but only a portion thereof. The sheath protects the portion of the reinforced concrete pile facing the poor-quality subsoil whereas the rest of the reinforced concrete pile is in direct contact with the subsoil. The direct contact between the concrete and the subsoil makes it possible to ensure a transfer of force from the reinforced concrete pile in a traditional way and therefore to keep the technical data applicable to traditional reinforced concrete piles.

BRIEF DESCRIPTION OF THE DRAWINGS

The disclosure will be better understood, thanks to the description hereinafter, which relates to an embodiment according to the present disclosure, given as non-limiting example and explained with reference to the appended schematic drawings, in which.

DETAILED DESCRIPTION OF THE DRAWINGS

Figure 1:
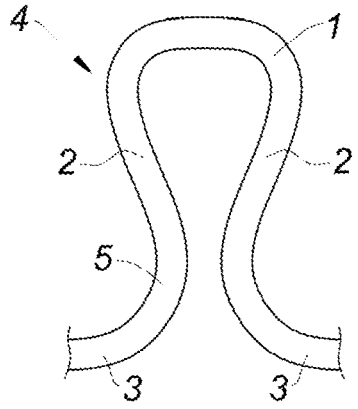
FIG. 1 is a schematic representation of a mesh.
Figure 2:
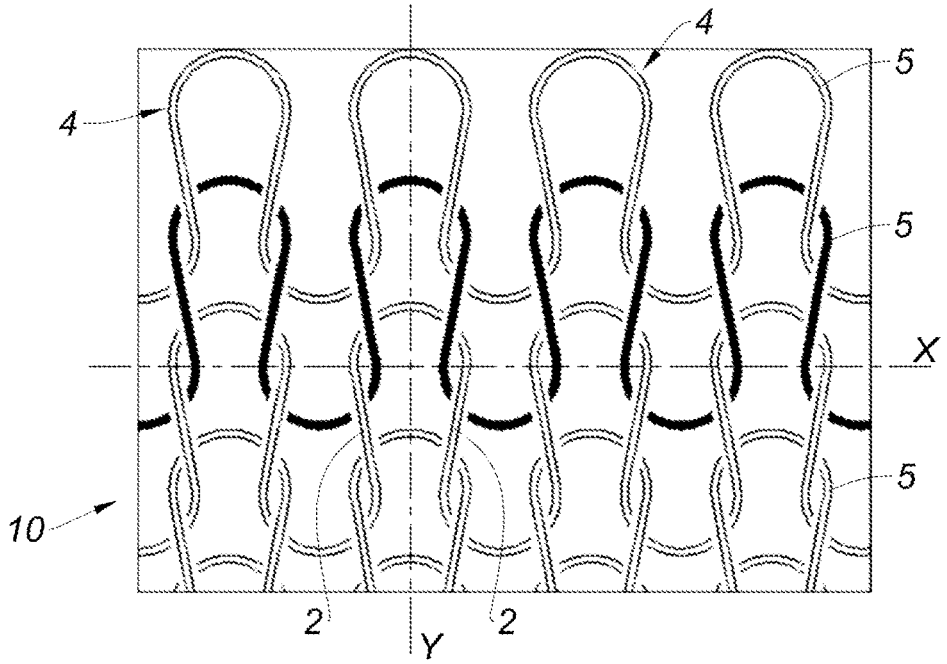
FIG. 2 is a schematic representation of a knit.

A knit 10, as represented in FIG. 2, is a fabric formed of loops of yarns 5 called «meshes» 4. A mesh 4, as represented in FIG. 1, is composed of a head 1, two legs 2 and two feet 3.

In a horizontal direction, that is to say according to an axis X transverse to an axis of elongation Y of the legs 2 of the mesh 4, a series of meshes 4 is called a row of meshes 4. In a vertical direction, that is to say according to the axis of elongation Y of the legs 2 of the mesh 4, a series of meshes 4 is called a column of meshes 4.

Figure 3:
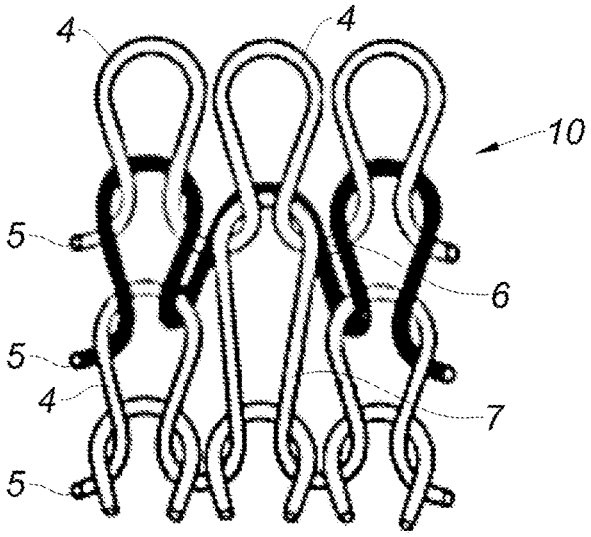
FIG. 3 is a schematic representation of a tuck mesh.

The knit 10 comprises a plurality of tuck meshes 7. FIG. 3 represents one single tuck mesh 7. The tuck mesh 7 is a mesh 4 on which is positioned a load loop 6.

The tuck meshes 7 are evenly positioned in the knit 10. Preferably, the tuck meshes 7 are positioned every 7 rows or every 17 rows.

Figure 4:
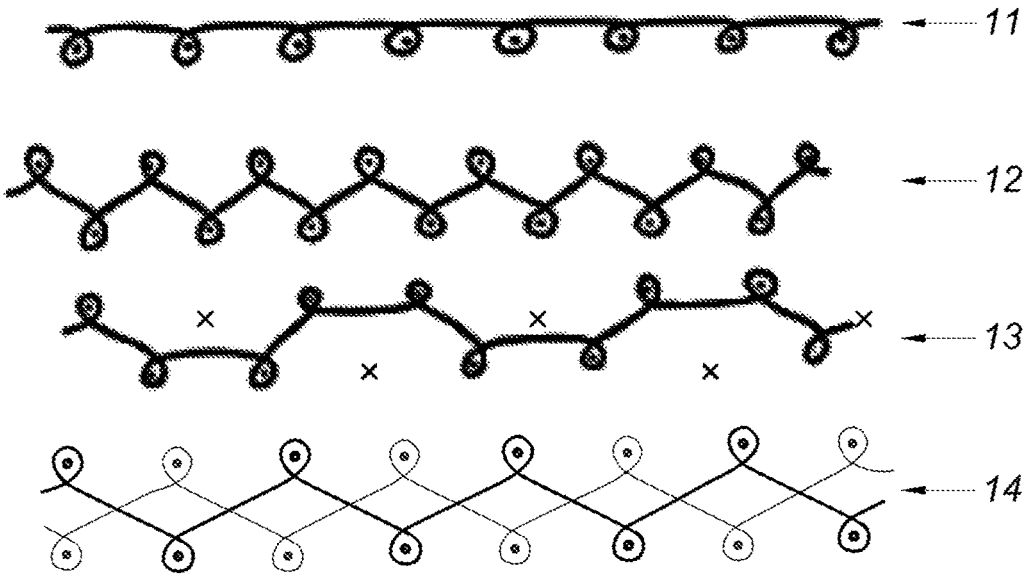
FIG. 4 is a representation of several mesh interlacing patterns.

Furthermore, the meshes 4 of the knit 10 may be interlaced according to different patterns as represented in FIG. 4.

For example, the meshes 4 can be interlaced according to a pattern called «Jersey» 11. In this pattern, all meshes 4 are threaded in the same way into the mesh 4 of the row below.

For example, the meshes 4 may be interlaced according to a pattern called "1/1 rib" 12. In this pattern, there is an alternation of a mesh 4 called "inside" and a mesh 4 called "outside".

For example, the meshes 4 may be interlaced according to a pattern called "interlock" 14. In this pattern, two "1/1 rib" patterns 12 are interlaced.

For example, the meshes 4 may be interlaced according to a pattern called "2/2 rib" 13. In this pattern, there is an alternation of two meshes 4 called "inside" and two meshes 4 called "outside".

Preferably, the meshes 4 of the knit 10 are interlaced according to the pattern called «2/2 rib» because the latter is more extensible according to the axis X transverse to the axis of elongation Y of the legs 2 of the mesh 4 than the pattern called «1/1 rib», unravel less easily than the pattern called «Jersey» and is faster to produce.

The knit 10 is made with yarns 5 made of a synthetic material.

A sheath 15 according to the disclosure is formed by the circular knit 10 comprising a series of meshes 4 helically positioned so as to form a tube. In other words, the circular knit 10 comprises a row of meshes 4 which winds on itself forming a helix. Each mesh 4 of the upper turn being tied to a mesh 4 on the lower turn.

The sheath 15, which is flexible, can be folded so as to be positioned in a plane. In the folded position, each point of an inner wall of the sheath 15 is in contact with a point of the diametrically opposed inner wall. In the folded position, the sheath 15 has two layers in contact with one another, interconnected by two opposite edges. A flat diameter of the circular knit 10 is a length comprised between the two edges and measured transversely to them.

The sheath 15 is intended to enable the production of a reinforced concrete pile 100 in a subsoil 20.

The considered subsoil 20 is formed by a series of layers. The upper layer, that is to say that which will be in contact with a construction, is called surface soil 21. It extends substantially between 0 meter and −5 meters. The next layer extends between −5 meters and −15 meters, it is formed by a so-called soft layer 22, that is to say containing a high proportion of compressible materials. The layer below −15 meters is formed by a stable layer 23. It may serve as a base for the reinforced concrete pile 100.

Figure 5:
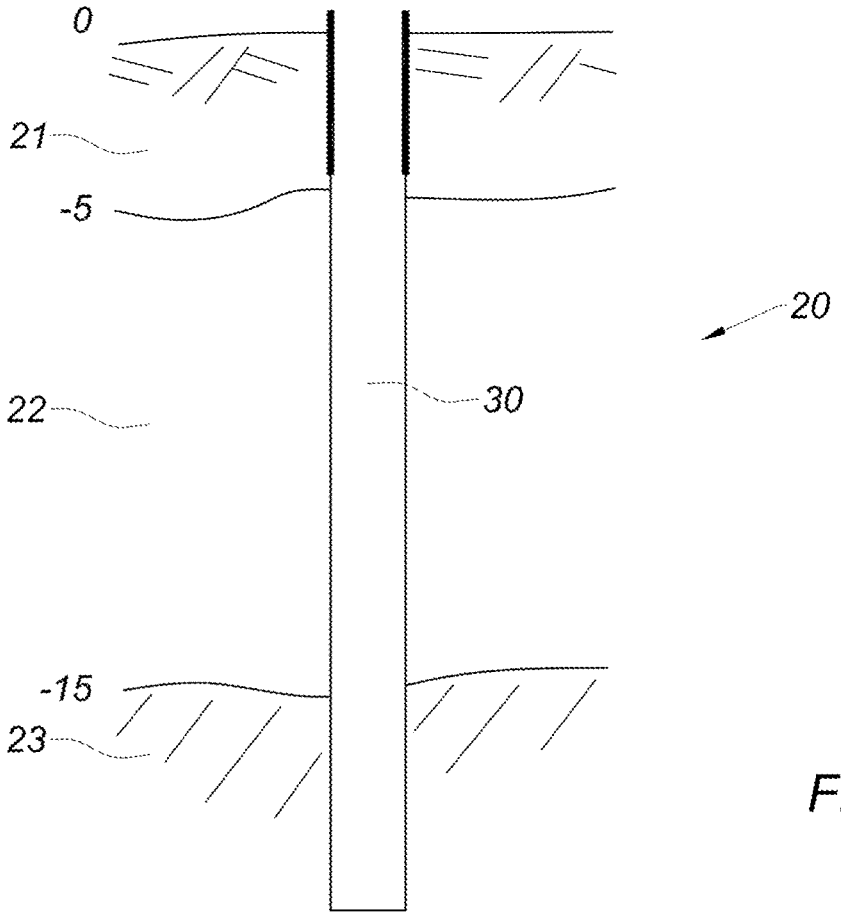
FIG. 5 is a schematic representation of an excavation step.

A method for making a reinforced concrete pile 100 comprises an excavation step, as represented in FIG. 5. The excavation step includes digging, generally by a drilling method, a subsoil 20 so as to form a well 30 between the surface soil 21 and the stable layer 23. The well 30 has a diameter comprised between 1 and 1600 millimeters. In our example represented in FIG. 5, the well has a diameter of 100 millimeters and a length of 20 meters.

Figure 6:
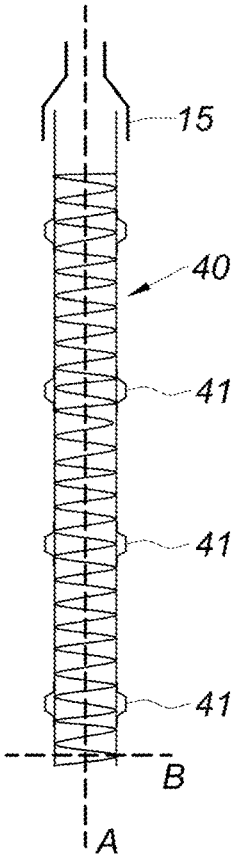
FIG. 6 is a schematic representation of an insertion step.

The method comprises, as represented in FIG. 6, a step of inserting one end of a reinforcing rod 40 into the sheath 15.

The reinforcing rod 40 is a hollow metallic structure which is substantially parallelepiped or cylindrical having a length according to an axis of elongation A of the reinforcing rod 40 substantially equal to a length of the well 30 and a width according to an axis B transverse to the axis of elongation A of the reinforcing rod 40 smaller than the diameter of the well 30.

Furthermore, the reinforcing rod 40 comprises spacers 41 evenly positioned along the length of the reinforcing rod 40.

The spacers 41 are metallic elements forming a shoulder on an external portion of the reinforcing rod 40.

The sheath 15 has a diameter at rest, that is to say when no force is exerted on the sheath 15, substantially smaller than the width of the reinforcing rod 40. In this way, the sheath 15 must be stretched radially, that is to say according to an axis transverse to an axis of elongation of the sheath 15, to let the reinforcing rod 40 pass.

Furthermore, the sheath 15 has a maximum diameter when stretched larger than the diameter of the well.

Finally, the sheath 15 has a length according to its axis of elongation larger than a height of the soft layer 22.

To perform the insertion step, the sheath 15 is stretched radially and then one end of the reinforcing rod 40 is placed inside the sheath 15.

The method then comprises a step of positioning the sheath 15 on a determined area of the reinforcing rod 40. The determined area is that which will be in contact with the soft layer 22 of the subsoil 20 after a step of inserting said reinforcing rod 40 into the well 30 has been carried out. When the sheath 15 is positioned on the determined area of the reinforcing rod 30, with no force stretching it radially, it seeks to return to its rest diameter. It thus sticks and hooks onto the reinforcing rod 40.

Figure 7:
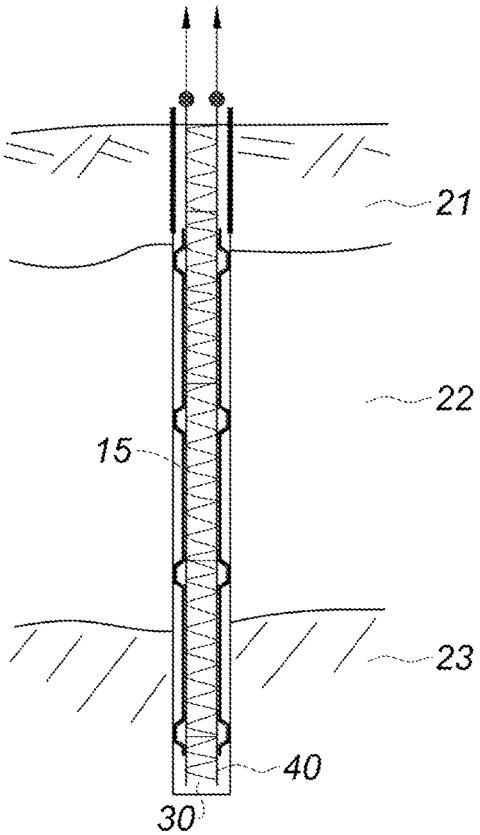
FIG. 7 is a schematic representation of an introduction step.
Figure 8:
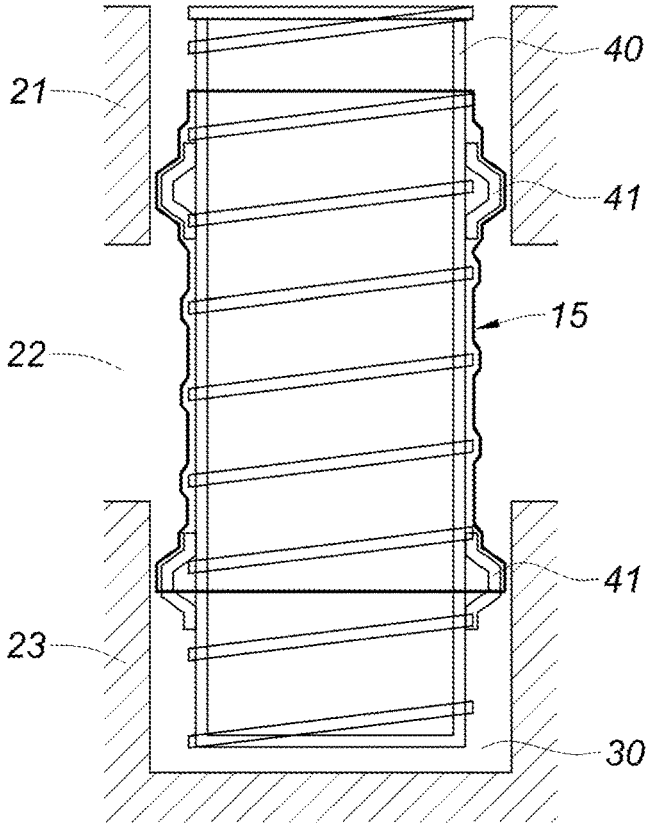
FIG. 8 is an enlarged-scale representation of the introduction step.

FIGS. 7 and 8 represent the reinforcing rod 40 on which is positioned the sheath 15 in the well 30 corresponding to an insertion step. The sheath 15 is opposite the soft layer 22 and pressed against the reinforcing rod 40. The reinforcing rod 40 is centered in the well 30 thanks to the spacers 41.

Figure 9:
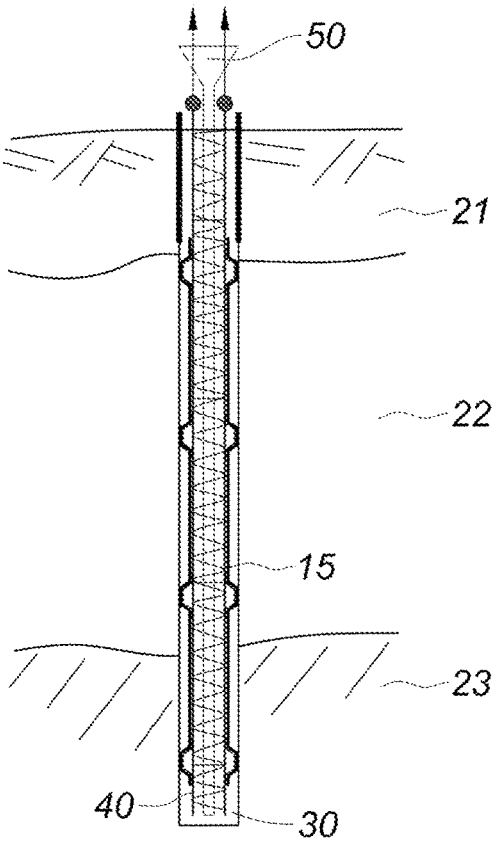
FIG. 9 is a schematic representation of an installation step.

Afterwards, a step of installing a tremie pipe 50 inside the reinforcing rod 40, as represented in FIG. 9 is carried out. The tremie pipe 50 is lowered into the well 30.

Figure 10:
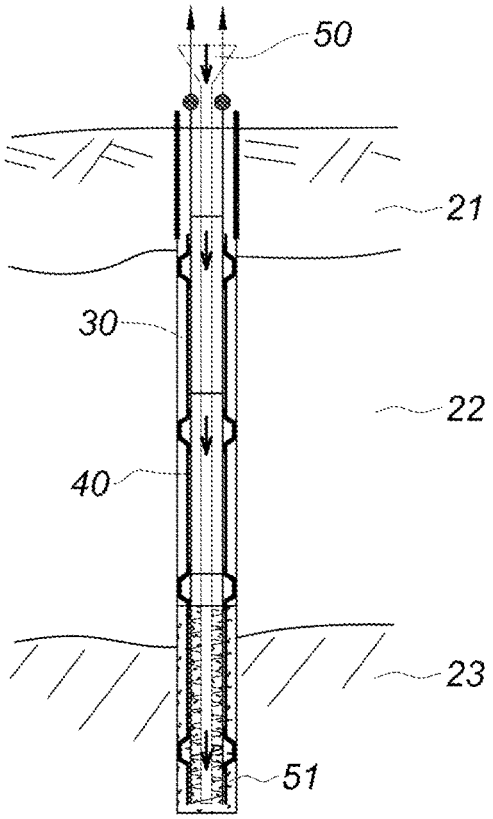
FIG. 10 is a schematic representation of a filling step.
Figure 11:
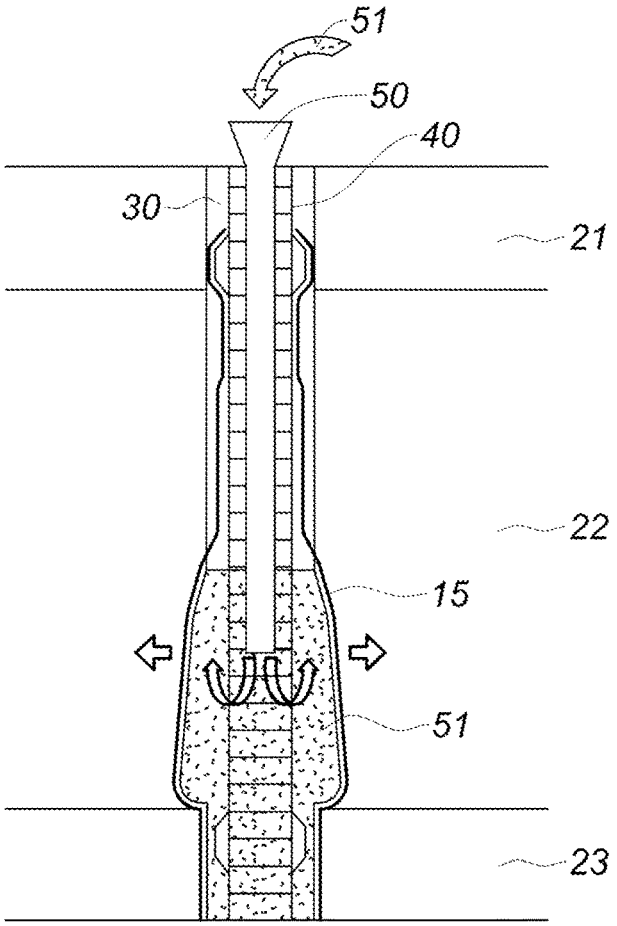
FIG. 11 is an enlarged-scale representation of the filling step.

Finally, a filling step is carried out as represented in FIGS. 10 and 11. During the filling step, concrete 51 is poured into the tremie pipe 50 so as to introduce it into the well 30. The concrete flow speed 51 is generally comprised between 30 and 70 $m^3/h$.

The concrete 51 exerts a radial force with respect to the elongation axis of the well 30. Thus, the concrete 51 pushes the sheath 15 radially. The sheath 15 deforms and extends. The concrete 51 is retained inside the sheath 15.

The sheath 15 expands radially until it reaches its maximum expansion or until it comes into contact with the rocks forming the walls of the well 30. Its expansion is then retained by said rocks.

The radial expansion of the sheath 15 makes it possible to resist the hydrostatic pressure of the concrete.

The expansion of the sheath 15 also allows the concrete 51 to coat the reinforcing rod so as to preserve it against oxidation phenomena.

Figure 12:
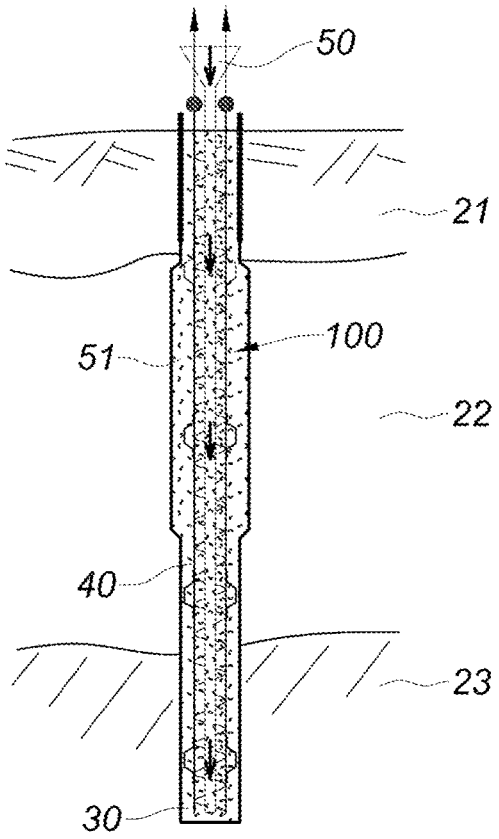
FIG. 12 is a schematic representation of a reinforced concrete pile made with a method according to the disclosure.
Figure 13:
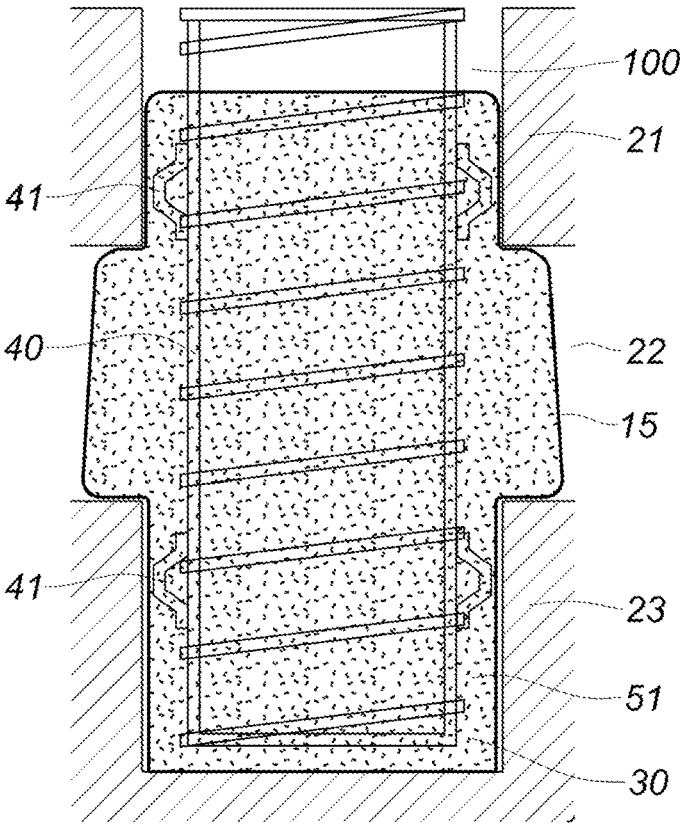
FIG. 13 is an enlarged-scale representation of the reinforced concrete pile of FIG. 12.

When the well 30 is filled with concrete, the reinforced concrete pile 100 is made as represented in FIGS. 12 and 13. The concrete forming the reinforced concrete pile 100 will then crystallize so as to become self-supporting. The sheath 15 is left in place.

As example, the disclosure also relates to a sheath made of a knit having a diameter of 800 mm, an extensibility in the horizontal direction, that is to say according to the diameter of the knit, of 80%, and an extensibility in the vertical direction, that is to say according to the axis of elongation of the sheath, of 10%. The sheath has a weight of 450 $g/m^2$ and is made only with synthetic high tenacity polyester yarns.

The above sheath is designed to be inserted over a determined area of a reinforcing rod having a substantially cylindrical hollow metallic structure.

In order to ensure that construction of the reinforced concrete pile is made secure, the method implements two identical sheaths which are independent of each other. The method of implementing the disclosure then comprises the step of inserting and the step of positioning a first sheath on the determined area of the reinforcing rod then the step of inserting and the step of positioning a second sheath on the determined area so that the two sheaths overlap. The second sheath finally covers the first sheath. Thus, the construction of the pile is secured in the event of failure of one of the sheaths.

The positioning step makes it possible to place the sheath on only one portion of the reinforcing rod which will be in contact with the soft layer of the subsoil after carrying out a step of introducing said reinforcing rod into the well. In this way, the sheath protects the portion of the reinforced concrete pile facing the soft layer of the subsoil whereas the rest of the reinforced concrete pile is in direct contact with the subsoil. The direct contact between the concrete and the subsoil makes it possible to ensure a transfer of force from the reinforced concrete pile in the traditional way and therefore to keep the technical data applicable to traditional reinforced concrete piles.

Of course, the disclosure is not limited to the embodiment described and represented in the appended figures. Modifications are still possible, in particular with regards to the constitution of the various elements or by substitution of technical equivalents, yet without departing from the scope of protection of the disclosure.

The invention claimed is:

1. A sheath for constructing a reinforced concrete pile, wherein the sheath is formed by at least one circular knit comprising a series of meshes helically interlaced so as to form a pipe in order to have a homogeneous seamless structure.

2. The sheath according to claim 1, wherein the at least one circular knit has an elasticity allowing for an elongation comprised between 10% and 400% of a flat diameter of said circular knit.

3. The sheath according to claim 1, wherein the at least one circular knit is permeable.

4. The sheath according to claim 1, wherein the meshes are interlaced according to a pattern selected from: a pattern called «Jersey», a pattern called "1/1 ribs", a pattern called "2/2 ribs", or a pattern called "Interlock".

5. The sheath according to claim 1, wherein the at least one circular knit comprises at least one tuck mesh.

6. The sheath according to claim 1, wherein the at least one circular knit is made with at least one yarn made of a material selected from: a synthetic material, a cellulosic material, a plant material, an animal material, a mineral material, and a metallic material.

7. The sheath according to claim 6, wherein the synthetic yarn is made of a material selected from: polyester, high tenacity polyester, high modulus polyethylene, high modulus polyester, and high modulus para-aramid.

8. The sheath according to claim 1, wherein the at least one circular knit is made with at least one yarn having a tenacity comprised between 5 and 50 cN/dtex.

9. A method for constructing a reinforced concrete pile, the method including the following steps:

excavating so as to form a well;

inserting one end of a reinforcing rod in a sheath formed by at least one circular knit comprising a series of meshes helically positioned so as to form a pipe;

positioning the sheath on a first area of the reinforcing rod;

introducing the reinforcing rod into the well;

installing a tremie pipe inside the reinforcing rod; and filling the well with concrete using the tremie pipe.

10. The constructing method according to claim 9, wherein the first area of the reinforcing rod is smaller than a total area corresponding to a total height of the reinforcing rod.

* * * * *